United States Patent [19]

McLoughlin et al.

[11] 4,079,122

[45] Mar. 14, 1978

[54] PREPARATION OF CARBON FIBRES

[75] Inventors: Victor Conrad Richard McLoughlin, Farnborough; Roger Moreton, Aldershot; William Watt, Farnborough, all of England

[73] Assignee: National Research Development Corporation, London, England

[21] Appl. No.: 735,215

[22] Filed: Oct. 22, 1976

[30] Foreign Application Priority Data

Oct. 24, 1975 United Kingdom ..... 43830/75

[51] Int. Cl.[2] ..... D01F 9/22

[52] U.S. Cl. ..... 423/447.8; 423/447.2; 423/447.4; 264/29.2; 423/447.6

[58] Field of Search ..... 423/447.4, 447.8, 447.1, 423/447.2, 447.6, 447.7; 264/29.2

[56] References Cited

U.S. PATENT DOCUMENTS 3,933,986 1/1976 Matsumura et al. ..... 423/447.7 X 3,961,888 6/1976 Riggs ..... 423/447.7

3,993,719 11/1976 Matsumura et al. ..... 423/447.1 X

FOREIGN PATENT DOCUMENTS 1,128,043 9/1968 United Kingdom ..... 423/447.8

*Primary Examiner*—Edward J. Meros

*Attorney, Agent, or Firm*—Cushman, Darby & Cushman

[57] ABSTRACT

A process for the production of carbon fibres is described in which a precursor fibre which is a copolymer of acrylonitrile, a chlorinated monomer, and itaconic acid containing between 2 to 20 molar parts of chlorinated comoner, between 0.5 and 5 molar parts of itaconic acid and 0 to 5 molar parts of other comonomers per 100 molar parts of acrylonitrile to a temperature in the range 200°–400° C while the natural shrinkage of the fibre is at least restrained followed by further heat treatment at a temperature in the range 800°–3000° C in a non-oxidizing atmosphere.

3 Claims, No Drawings

PREPARATION OF CARBON FIBRES

The invention relates to the manufacture of carbon fibre.

In the prior art two types of process have been proposed for converting polyacrylonitrile based fibres into carbon fibres. The first of these processes involves a very slow heating of the fibre in an inert atmosphere from room temperature up to a temperature of the order of 1000° C. For example UK Patent No. 1,128,043 contemplates heating the fibre from room temperature at a rate not exceeding 1° C per minute up to a temperature of 1000° C. The second prior art process, which is described in UK Patent No. 1,110,791, involves two heat treatment stages, a first step in which the fibre is heated in an oxidizing atmosphere at a temperature in the region 200°–250° C and a second step in which the fibre is heated in an inert atmosphere to a temperature in the order of 1000° C. Both processes contemplate the possibility of further heat treatment at temperatures of up to 2500° C.

The purpose of the first step of the second prior art process is to form an intermediate which is stable to further heat treatment and replaces the prolonged heating stage of the first prior art process. It must be carried out for sufficient time to allow oxygen to react throughout the fibre. Both of these processes are prolonged and in general any attempt to shorten them, by for example increasing the rate of heating, leads to an unacceptable degradation of fibre properties.

According to the present invention carbon fibers are produced by the steps of at least heating an organic polymeric precursor fibre to a temperature in the range 200°–400° C in an inert atmosphere whilst the natural shrinkage of the fibre is at least restrained followed by further heat treatment at a temperature in the range 800°–3000° C in a non-oxidising atmosphere, wherein the organic polymeric precursor is a copolymer of arcylonitrile, a chlorinated monomer and itaconic acid containing between 2 to 20 molar parts of chlorinated comonomer, between 0.5 and 5 molar parts of itaconic acid and 0 to 5 molar parts of other comonomers per 100 molar parts of acrylonitrile.

The chlorinated comonomer may be any comonomer which is capable of intermolecular elimination of hydrogen chloride. Examples of suitable chlorinated comonomers are vinyl chloride, vinylidene chloride and γ-chloroacrylonitrile. Advantageously the chlorinated comonomer is vinylidene chloride and is present to the extent of 3 to 15 molar parts per 100 molar parts of acrylonitrile. In a preferred embodiment the organic polymeric precursor is a copolymer of acrylonitrile, vinylidene chloride and itaconic acid contaning 4 molar parts of vinylidene chloride and 4 molar parts of itaconic acid per 100 molar parts of acrylonitrile.

It is believed, though this should not be considered as limiting the scope of the present invention, that the inclusion of suitable chlorinated comonomers in polyacrylonitrile leads to a reduction in the exothermic reactions which take place on pyrolysis and facilitates cross-linking between polymer chains, in the temperature range 180°–350° C. The reduction in the exothermic reactions allows a greater rate of heating to be used without causing thermal runaway. Although it is possible to produce suitable carbon fibres from a polyacrylonitrile copolymer containing only the aforementioned chlorinated comonomers, it has been found that the inclusion of small quantities of itaconic acid comonomer in the polyacrylonitrile copolymer improves the properties of the carbon fibres obtained. The specific mode of action of the itaconic acid is uncertain though the desirable advantages introduced may be due to its action as an initiator for the cyclisation of polyacrylonitrile during pyrolysis.

The invention also includes carbon fibres produced by the above described methods.

The invention will now be illustrated by way of example only with reference to the following Examples of which Examples 2 and 3 are control experiments.

EXAMPLE 1

An acrylonitrile, vinylidemechloride, itaconic acid copolymer containing 4 mol of itaconic acid and 4 mol of vinylidene chloride per 100 mol of acrylonitrile was dissolved in a 50% W/W solution of aqueous sodium thiocyanate to form a 12% W/W polymer solution and the resultant solution passed through a spinnerette into a coagulation bath of 10% W/W aqueous sodium thiocyanate solution. The resultant fibres were washed by passing them through a bath of distilled water and were steam stretched by a factor of 12. The diameter of the fibres finally produced was 23.2 μm.

A sample of the fibres precursor was converted into carbon fibres by heating in a nitrogen atmosphere, initially at 400° C for 6 hours and finally at 1000° C for ½ hour. During the heating the fibres were wound on to silica frames to restrain shrinkage of the fibres. The carbon fibres produced were then removed from the frames and a portion of the fibres produced subjected to further heat treatment in an argon atmosphere at 2500° C for ½ hour.

Some properties of the carbon fibres produced in accordance with the invention are shown in Table 1. below.

EXAMPLE 2

A copolymer of acrylonitrile and vinylidene chloride containing 4 mol of vinylidene chloride per 100 mol of acrylonitrile was dissolved in a 50% W/W solution of aqueous sodium thiocyanate to form a 10% W/W polymer solution. This solution was then passed through a spinnerette into a coagulation bath of 10% W/W aqueous sodium thiocyanate solution, the resultant fibres washed by passing them through a bath of distilled water and then steam stretched by a factor of 14. The final fibre diameter was 17.0 μm. These fibres were converted into carbon fibres as described in Example 1. Some properties of these carbon fibres produced are shown in Table 1 below.

EXAMPLE 3

A batch of "Courtelle" fibre having a diameter of 12.8 μm was converted into carbon fibre by the method described in Example 1. "Courtelle" is a commercially available polyacrylonitrile fibre suitable as a carbon fibre precursor sold by Courtaulds Ltd and containing about 6 mol per cent of methyl acrylate. Some properties of the carbon fibres produced are shown in Table 1 below.

TABLE 1

| Properties of carbon fibres produced | Precursor | Acrylonitrile, vinylidene chloride itaconic acid copolymer | Acrylonitrile, vinylidene Chloride copolymer | Courtelle |
|---|---|---|---|---|
| After carbonisation at 1000° C | Percentage yield of carbon fibre from precursor material | 41 | 33 | 29 |
| | Fibre diameter μm | 13.4 | 8.3 | 7.7 |
| | Youngs Modulus $10^6$ psi | 23 | 20 | 16 |
| | Ultimate tensile strength $10^3$ psi | 198 | 93 | 128 |
| After further heat treatment at 2500° C in argon | Fibre diameter μm | 12.7 | 7.3 | 6.3 |
| | Youngs Modulus $10^6$ psi | 39 | 38 | 33 |
| | Ultimate tensile strength $10^3$ psi | 158 | 137 | 173 |

A shown in Table 1 carbon fibres produced from an acrylonitrile-vinylidene chloride-itaconic acid copolymer precursor in accordance with the present invention have superior properties to, and are produced in a greater yield than, those produced from acrylonitrile/-vinylidene chloride copolymer or "Courtelle" precursors, details of which are included for comparative purposes only. Of particular note is the high ultimate tensile strength and high yield of fibres produced by the process of the present invention with carbonisation at 1000° C and without further heat treatment.

It will of course be realised that carbon fibres having better mechanical properties than those of the carbon fibres produced in accordance with the present invention can be produced from "Courtelle" but this can only be achieved by using more sophisticated and costly techniques. However, application of such techniques to the present invention may result in a consequent improvement of fibre properties.

What we claim is:

1. In a process for the production of carbon fibres from organic polymeric precursor fibres comprising the steps of heating the fibre to a temperature in the range of about 200° – 400° C in an inert atmosphere while the natural shrinkage of the fibre is at least restrained, followed by further heat treatment at a temperature of the range of about 800° to 3000° C in a nonoxidizing atmosphere, thereby producing a carbon fibre, the improvement wherein the organic polymer precursor is a copolymer of acrylonitrile, a chlorinated comonomer selected from the group consisting of vinyl chloride, vinylidene chloride and chloroacrylonitrile, and itaconic acid, said organic polymer precursor containing between about 2 to 20 molar parts of said chlorinated comonomer, between about 0.5 and 5 molar parts of itaconic acid and up to 5 molar parts of other comonomers per 100 molar parts of acrylonitrile.

2. A process as claimed in claim 1 wherein the chlorinated comonomer is vinylidene chloride and is present to the extent of about 3 to 15 molar parts per hundred parts of acrylonitrile.

3. A process as claimed in claim 1 wherein the organic polymer precursor is a copolymer of acrylonitrile with 4 molar parts of vinylidene chloride and 4 molar parts of itaconic acid per 100 molar parts of acrylonitrile.

* * * * *